United States Patent [19]

Lin

[11] Patent Number: 4,991,568

[45] Date of Patent: Feb. 12, 1991

[54] MASSAGE DEVICE

[75] Inventor: Pin-Hung Lin, Taipei, Taiwan

[73] Assignee: Ching-Sung Lin, Taipei Hsien, Taiwan

[21] Appl. No.: 332,898

[22] Filed: Apr. 4, 1989

[51] Int. Cl.[5] ..... A61H 7/00; A61H 11/00

[52] U.S. Cl. ..... 128/64; 128/52; 128/44

[58] Field of Search ..... 128/64, 55, 59, 60, 128/61, 44, 52

[56] References Cited

U.S. PATENT DOCUMENTS

| | | | |
|---|---|---|---|
| 1,253,232 | 1/1918 | Guilferd | 128/64 |
| 1,253,233 | 1/1918 | Guilferd | 128/64 |
| 1,701,956 | 2/1929 | McDonald | 128/64 |
| 1,795,893 | 3/1931 | Rosett | 128/64 |
| 2,220,836 | 11/1940 | Closson | 128/60 |
| 2,836,174 | 5/1958 | Infanger | 128/64 |
| 3,396,721 | 8/1968 | Mencacci | 128/64 |
| 3,503,388 | 3/1970 | Cook | 128/60 |
| 3,734,087 | 5/1973 | Sauer et al. | 128/64 |
| 3,774,598 | 11/1973 | Wilson et al. | 128/64 |
| 4,574,787 | 3/1986 | Jacobs | 128/64 |
| 4,615,336 | 10/1986 | Fijimoto | 128/44 |
| 4,753,226 | 6/1988 | Zheng et al. | 128/64 |
| 4,858,596 | 8/1989 | Kolstedt et al. | 128/64 |

FOREIGN PATENT DOCUMENTS

| | | | |
|---|---|---|---|
| 321545 | 3/1970 | Sweden | 128/64 |
| 429059 | 5/1935 | United Kingdom | 128/61 |
| 658866 | 2/1950 | United Kingdom | 128/64 |

*Primary Examiner*—Clifford D. Crowder
*Assistant Examiner*—Eric P. Raciti
*Attorney, Agent, or Firm*—Leonard Bloom

[57] ABSTRACT

A massage device having a drive unit and a massage unit connected by a flexible drive link such as a sheathed cable. The drive unit generates reciprocating motion which is transmitted to the massage unit via the drive link. The reciprocating motion may be produced by a reversible motor.

23 Claims, 5 Drawing Sheets

MASSAGE DEVICE

This invention relates to a massage device, and more particularly to a massage device for promoting blood circulation, which is simple to operate and fully adjustable.

It is well known that repeated application and release of pressure on the body, i.e. massage, can promote blood circulation with beneficial effect on, for example, muscular injuries. Blood circulation is improved particularly when pressure is applied and released at high frequency.

A known massage device, disclosed in Taiwanese patent application No. 6211907 employs a compressor which supplies compressed air to an air bag. The air bag is applied to a subject and is repeatedly inflated for a period of time and deflated, the air pressure and the period of time being controlled by suitable control circuit.

The prior art device described above suffers from several disadvantages. For instance, the air bag is susceptible to leaks and the compressor is noisy. Moreover, the device is bulky, expensive and complex and, in consequence, the device is unsuitable for domestic use and is not portable.

An object of this invention is to overcome or to mitigate the drawbacks of known massage devices exemplified by the device described above.

This invention provides a massage device comprising a massage unit connected to a drive unit by a flexible drive link.

In a currently preferred embodiment, the drive unit contains an oscillatory mechanism which transmits reciprocatory motion to the message unit via a sheathed cable.

Preferably, the massage unit comprises a massage head unit and a flexible belt which, in use, is moved in reciprocatory fashion by the massage head unit.

The drive unit suitably comprises a reversible rotational drive, a crank, sensing means and control means arranged to stop and reverse the drive when the crank reaches an angular position sensed by the sensing means. The sensing means preferably comprises one or more limit switches situated one on either side of the drive's rotational axis.

In a preferred arrangement, the massage head unit comprises a body having an oscillatory member projecting therefrom, to which the massage belt is attached.

Embodiments and aspects of this invention will now be described, by way of example, with reference to the accompanying drawings in which.

Figure 1:
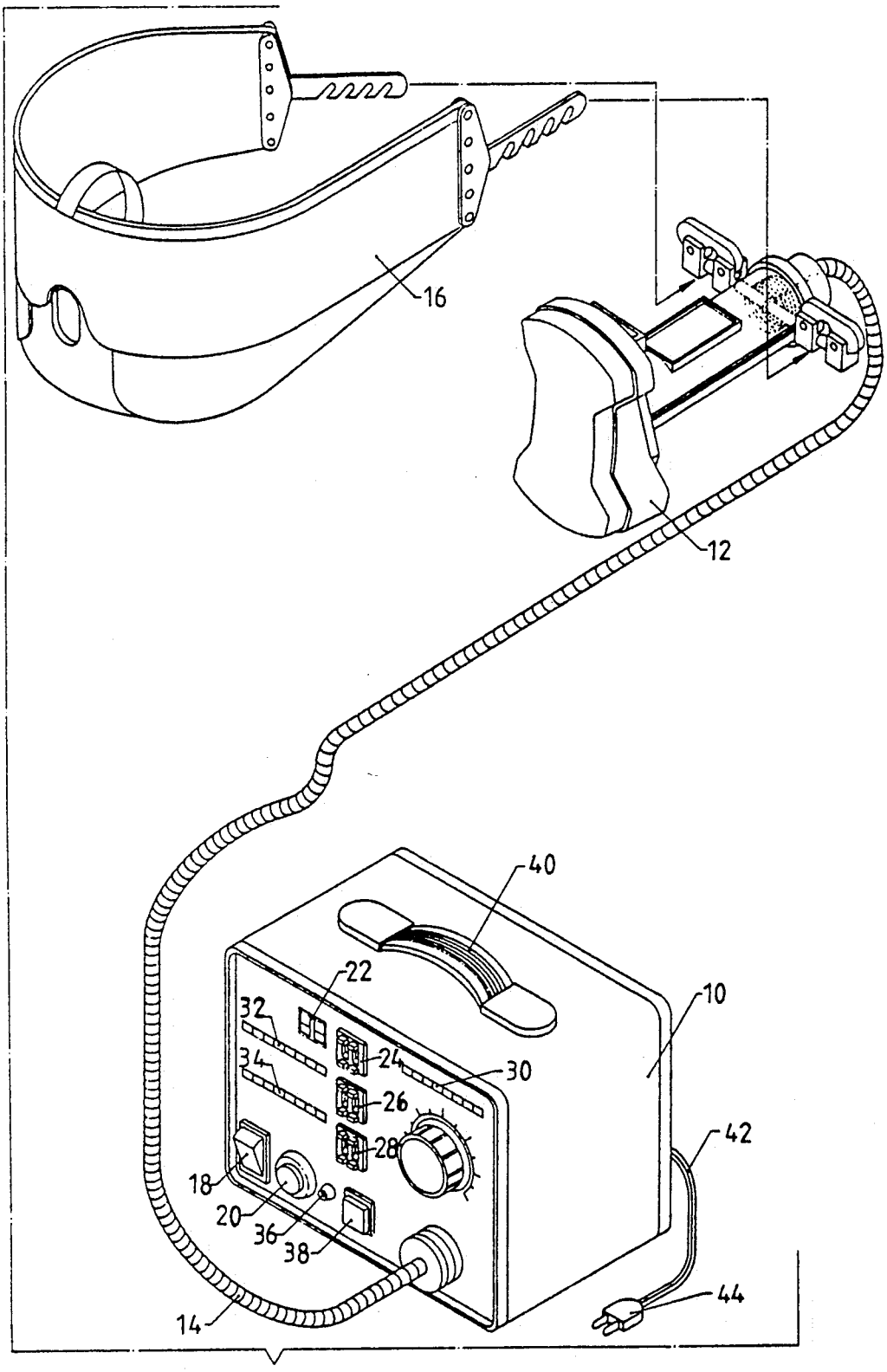
FIG. 1 is a perspective view showing a preferred embodiment of the invention in a partially disassembled state.

Referring to the drawings, a preferred embodiment of this invention comprises a drive unit 10 connected to a massage head unit 12 by a drive cable 14. The massage head unit 12 carries a massage belt 16 for embracing a subject in use.

The drive unit 10, which contains control circuitry as well as a drive mechanism, has a display panel which carries an on/off switch 18, a start switch 20, a digital display 22, three time controls 24, 26 and 28, a power indicator lamp 30, a compression indicator 32, a pressure-relief indicator 34, a flashing indicator 36 and an auxiliary switch 38. The purpose of these switches and indicators will be explained below. The drive unit 10 also has a carrying handle 40 and a power lead 42 with a plug 44 at its end.

Figure 2:
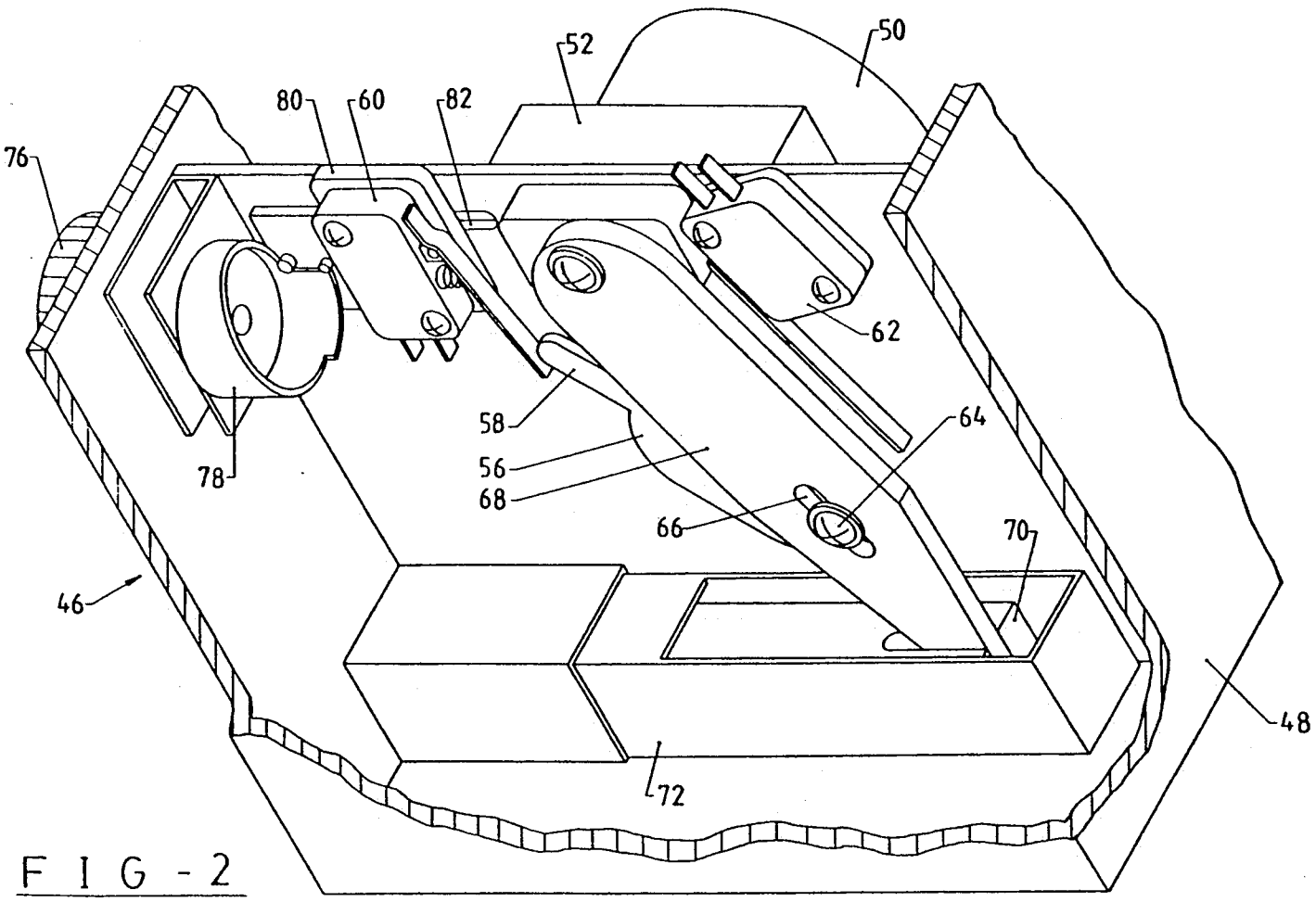
FIG. 2 is a part-sectioned perspective view illustrating the internal arrangement of the drive mechanism of the preferred embodiment.
Figure 8:
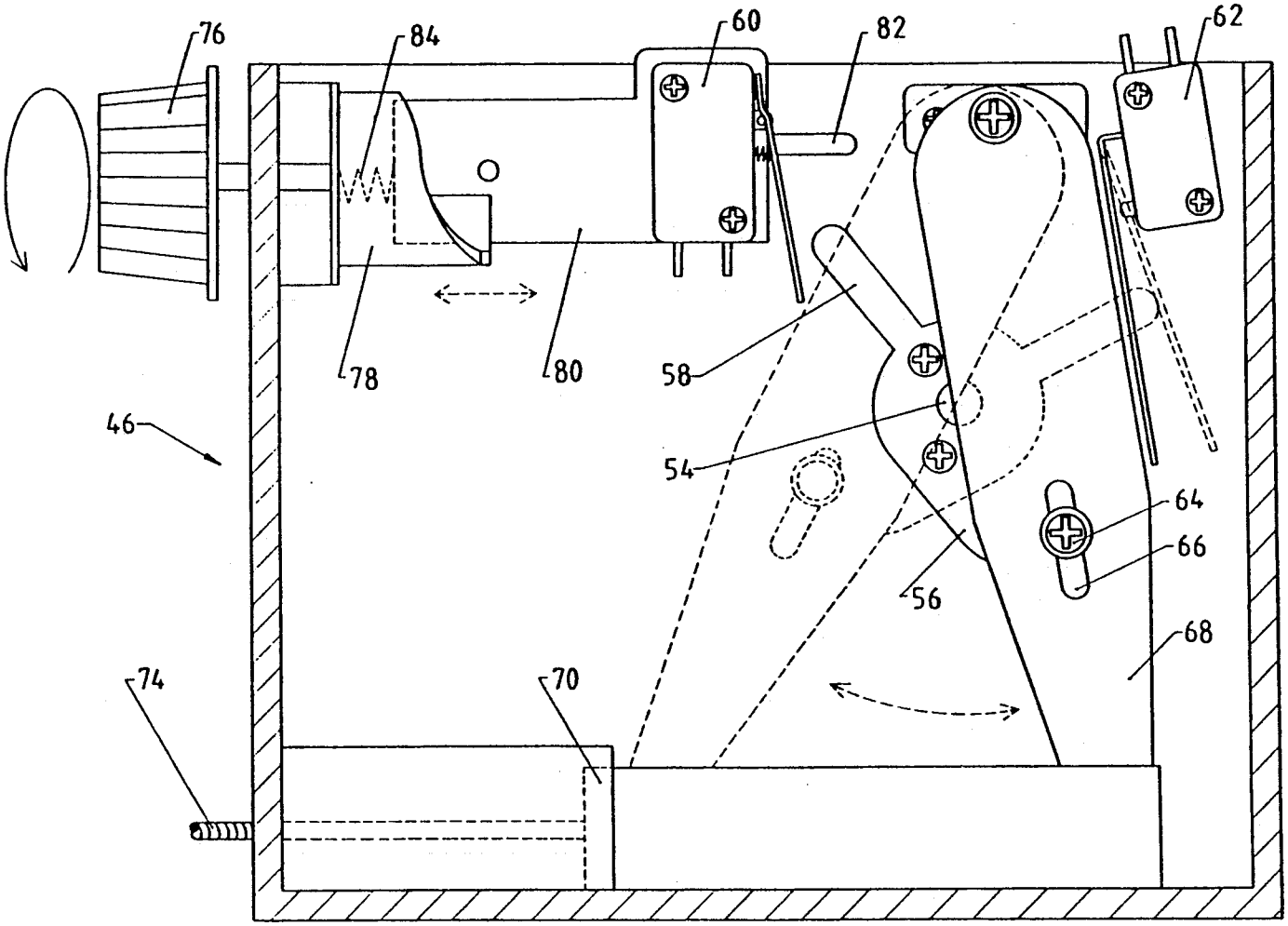
FIG. 8 is a sectional side view of the drive mechanism shown in FIG. 2.

The drive mechanism 46 contained within the drive unit 10 is illustrated in detail in FIGS. 2 and 8. The drive mechanism 46 has a case 48, which carries a reversible electric motor 50 driving through a speed-reducing gearbox 52. Gearbox 52 has an output shaft 54 which enters the case 48.

The gearbox output shaft 54 carries a crank plate 56. The crank plate 56 has a substantially elliptical body with a protruding finger 58 at its broad (upper) end. The finger 58 is arranged to contact, and thereby trigger, limit switches 60, 62 when the crank plate 56 reaches certain angular positions as the gearbox output shaft 54 turns. When triggered, the limit switches 60, 62 cause the motor 50 to reverse its direction of movement. Consequently, the crank plate 56 moves in oscillatory fashion through a limited range of angular movement. For a given crank plate 56, the range of movement is defined by the positions of the limit switches 60,62 relative to the gearbox output shaft 54.

The crank plate 56 has an orthogonally-projecting peg 64 at its narrow (lower) end. The peg 64 is received in a slot 66 provided in a rocker arm 68, which arm 68 is pivotally attached at its upper end to the case 48. The rocker arm 68 is driven in oscillatory fashion by the crank plate 56.

The lower, free end of the rocker arm 68 is received by a recess provided in a block 70. The block 70 is slidable relative to a guide member 72 provided on the bottom surface of the case 48, and is driven in reciprocatory, piston-like fashion along a straight line by the rocker arm 68.

The block 70 is attached to a core 74 within the sheathed drive cable 14, and causes the core 74 to move in reciprocatory fashion. The sheath at one end of the drive cable 14, which sheath is of PVC material, is anchored to the case 48 so that, when driven, the core 74 moves within the sheath. The other end of the drive cable 14 is attached to the massage head unit 12.

The drive unit 10 is provided with means for adjusting the amplitude of oscillatory movement. One limit switch (62) is fixed relative to the gearbox output shaft 54 but the other limit switch (60) is movable relative to the shaft so that the angular position at which the finger 58 contacts the limit switch 60 can be altered. Consequently, the crank plate 56 can be allowed to move to a greater or lesser degree before the motor 50 is reversed.

The position of limit switch 60 can be adjusted by means of a knob 76 provided on the outside of the drive unit 10. The knob 76 is connected to a helical cam 78 within the case 48. The limit switch 60 is carried by a sliding member 80, which is slidable along a slot 82 provided in the case 48. The sliding member 80 is held against the cam 78 by a spring 84 and is therefore moved along the slot 82 when the knob 76 and cam 78 are turned. This varies the position of the limit switch 60.

Figure 3:
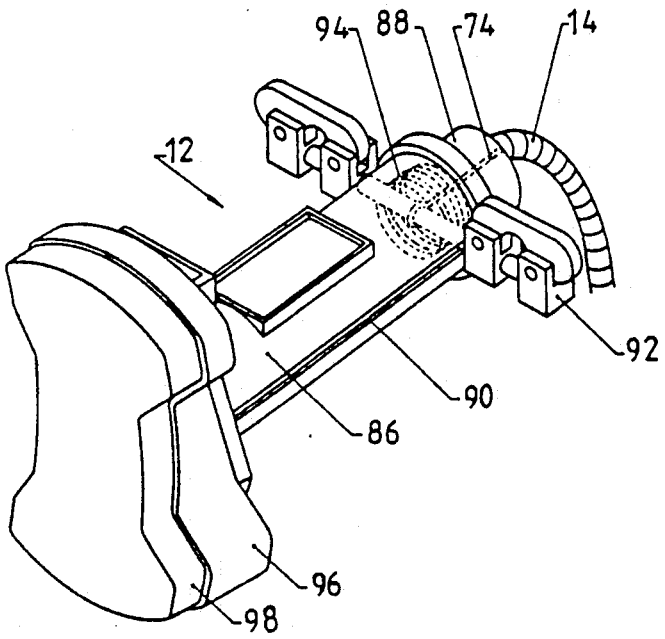
FIG. 3 is a perspective view showing another component of the preferred embodiment.

A preferred massage head unit 12 is illustrated in FIG. 3, and comprises a tubular body portion 86. One end of the body portion 86 carries an end-cap 88 to which is attached the sheath of the drive cable 14. An elongate groove 90 extends axially along each side of the body portion 86. The grooves 90 carry a transverse pin 92, to which the core 74 of the drive cable 14 is firmly anchored. The pin 92 is therefore driven to and fro along the grooves 90 when the core 74 is driven in reciprocatory fashion as described above. A coil spring 94 surrounds the core 74 and acts between the end-cap 88 and the pin 92 to secure the pin 92.

The end of the body portion 86 opposite the drive cable 14 carries an enlarged plate 96. The plate 96 carries a pad 98, which is a layer of elastomeric material such as a sponge.

Figure 5:
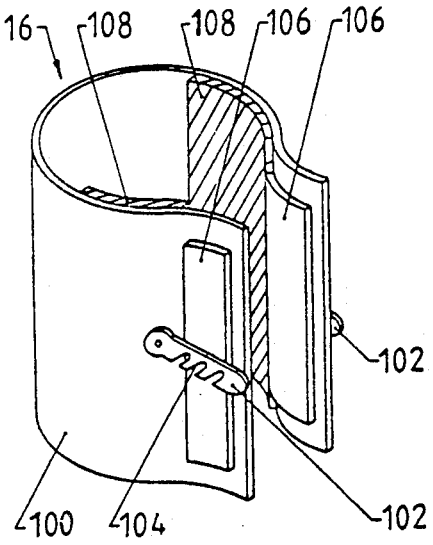
FIG. 5 is a perspective view of the massage belt of the preferred embodiment.

The massage belt 16 shown in FIG. 5 comprises a broad rectangular elastic strap 100 of rubber or the like, which carries two tabs 102, one tab situated adjacent each end of the strap 100. Each tab 102 has three spaced angled slots 104 whereby the massage belt 16 can be attached to the pin 92 of the massage head unit 12.

The strap 100 has two fastening patches 106 of releasable adhesive or hook-and-eye material, one patch 106 being situated adjacent each end of the strap 100. One patch 106 is located on one surface of the strap 100 and the other patch 106 is situated on the other surface of the strap 100, so that the two patches 106 are brought together for fastening when the ends of the strap 100 are overlapped. The strap 100 also has pads 108 on its inner surface, the pads 108 being of sponge or soft cloth material to promote user comfort.

In use, the massage belt 16 is tightly wrapped around the part of the user's body to be massaged, and is then attached to the massage head unit 12 by engaging the pin 92 in an appropriate slot 104 of each tab 102. The massage belt 16 cooperates with the plate 96 of the massage head unit to surround the subject being massaged.

Before the drive unit 10 is actuated, the time control 24 is set to a desired total operating time (say fifteen minutes), then the time control 26 is set to a desired compression time (say fifteen seconds), and finally the time control 28 is set to a desired release time (say five seconds).

Once set, the drive unit 10 is actuated by pressing the on/off switch 18 and then pressing the start switch 20. The power indicator lamp 30 is linked to the on/off switch 18 and is illuminated when the power is on.

Upon actuation, the motor 50 drives in a direction to compress the subject, by moving the crank plate 56, the rocker arm 68 and the block 70. This in turn moves the core 74 of the drive cable 14, causing the pin 82 of the massage head unit 12 slowly to pull the massage belt 16. The massage belt 16 is therefore gradually tightened about the subject held between the belt 16 and the plate 96 of the massage head unit 12.

The motor 50 continues to turn, progressively tightening the massage belt 16, until the finger 58 contacts the limit switch 60. The motor 50 is then stopped and the time control 26 counts down for its set time (e.g. fifteen seconds) when the subject is held in compression. Compression indicator 32 illuminates during this compression period and a buzzer generates a tone or music.

At the end of the compression period determined by the time control 26, the motor 50 turns in a reverse direction thereby relieving pressure on the subject. The pressure is relieved gradually, a process aided by the elasticity of the strip 100 of the massage belt 16. The motor 50 is stopped again when the finger 58 contacts the limit switch 62, and from this moment the time control 28 counts down for its set time (e.g. five seconds). At the end of this relief period the motor 50 starts again in the original direction and the process continues thereafter for the period determined by the time control 24. The buzzer then sounds a tone or music to indicate the end of the therapy.

A second buzzer is connected in series to a pressure sensor switch, the switch being arranged such that the second buzzer will not sound if the force exerted upon the massage belt is below a certain value.

Where the massage device of this invention is used for massaging the eyes, the auxiliary switch 38 can be depressed whereby the user can massage the eyes for a certain period (say six minutes) matched with the flashing indicator 36. The second buzzer sounds once after a short period (say two minutes).

Figure 4:
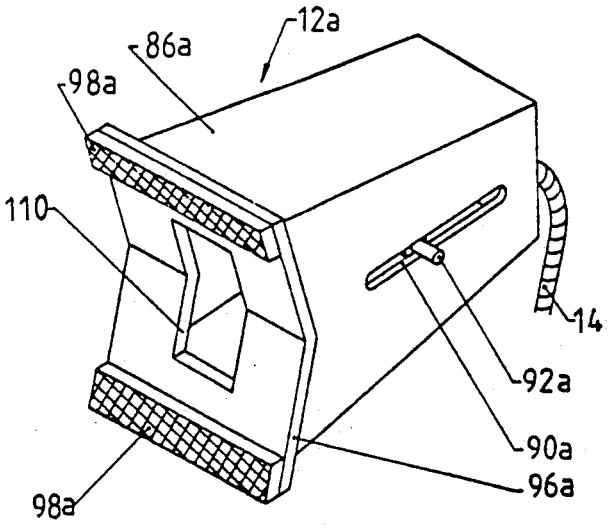
FIG. 4 is a perspective view showing an alternative embodiment of the massage head unit shown in FIG. 3.

Many modifications are possible. FIG. 4 shows a modified massage head unit **12*a* which is different in shape to that described above but which retains features such as a body portion 86*a*, a transverse pin 92*a*, two grooves 90 and a plate 96*a* carrying a pad 98*a*. In the FIG. 4 embodiment, the body portion 86*a* is substantially cuboid in shape and the plate 96*a* has an opening 110 therein to receive a portion of the user's body (such as his or her nose). The pad 98*a* is split into two portions, one portion being situated on either side of the opening 110**.

Figure 6:
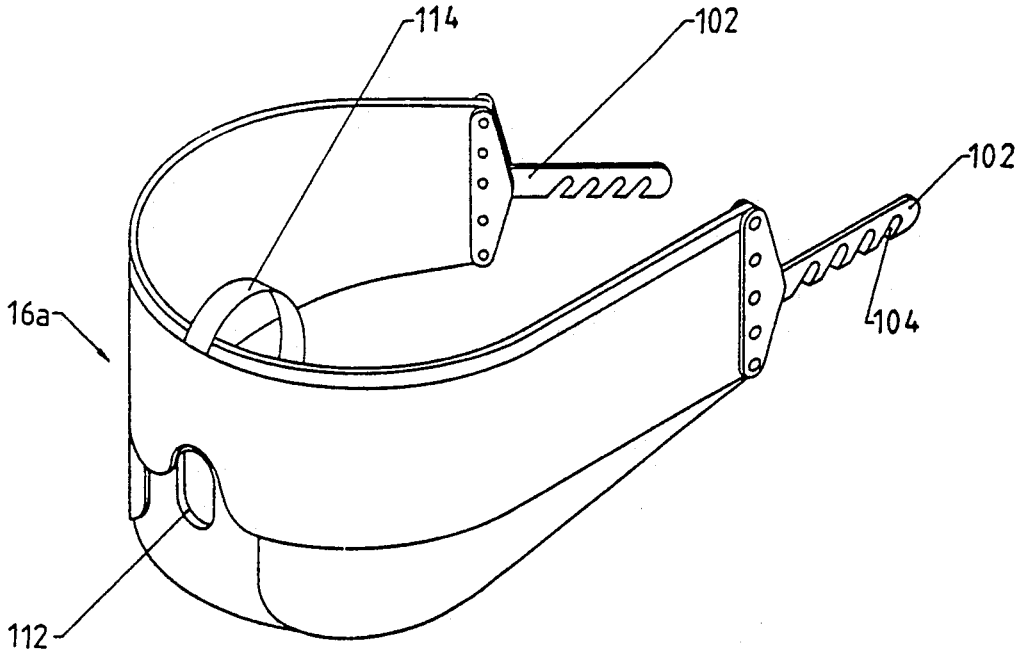
FIG. 6 is a perspective view showing an alternate embodiment of the massage belt shown in FIG. 5.
Figure 7:
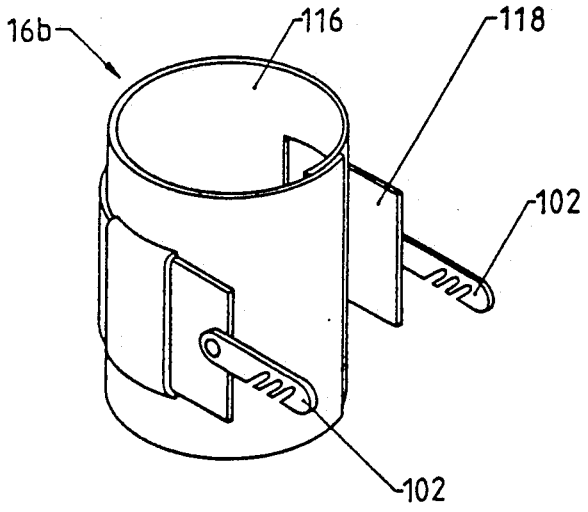
FIG. 7 is a perspective view showing a further alternate embodiment of the massage belt shown in FIGS. 5 and 6.

The massage belt 16 may also be modified to suit various applications, and modified embodiments are shown in FIGS. 6 and 7. The massage belt **16*a* shown in FIG. 6 is particularly suitable for use in massaging the face, and has an opening 112 therein through which the subject's nose can protrude. The belt 16*a* is of layered construction, and releasable attachment means are used to join certain layers so that the shape and tightness of the belt can be adjusted to suit the particular user. An elasticated strap 114** is also provided to embrace the user's head.

FIG. 7 illustrates a massage belt **16*b* which is of two-part construction, having an inner strap 116 attached to an outer strap 118. The inner strap 116, which is wider than the outer strap 118**, contains an internal pad for contacting the user's skin.

Use of the device of this invention promotes blood circulation, increases the metabolic rate and massages the user's muscles.

As will be clear to those familiar with the art of massage devices, this invention provides a device which is simple and reliable, and which can be readily adjusted. The device is compact, readily portable and inexpensive to produce. Moreover, the device has a smooth and comfortable massaging action.

I claim:

1. A massage device comprising: a massage head unit having a body portion and an enlarged plate carried by the body portion for contacting parts of a user's body being massaged, a massage belt for contacting further parts of a user's body being massaged, whereby the massage belt cooperates with the enlarged plate to substantially surround and embrace a user's body being massaged, reciprocating means carried by the body portion for moving the massage belt in a reciprocating motion, such that the user is massaged, a drive unit including a drive mechanism for producing a reciprocating drive motion and a flexible drive link located between and connected to the drive mechanism and the reciprocating means for transmitting the reciprocating drive motion from the drive mechanism to the belt, such that the user's body is massaged thereby.

2. The massage device according to claim 1, wherein the flexible drive link is a sheathed cable.

3. The massage device according to claim 1, wherein the drive unit comprises: a reversible drive motor having an output, a gearbox associated with the drive motor for translating the output of the motor into an oscillating motion, a pivotal rocker arm connected to the gearbox for pivotal oscillating movement of the rocker arm in response to the translational output of the output of the motor, whereby the rocker arm is moved in an oscillary motion in response to the output of the motor, the rocker arm having a cable attached thereto, such that the oscillating movement of the rocker arm reciprocates the cable for producing the reciprocating drive motion, sensing means for sensing the pivotal oscillating movement of the rocker arm, and control means associated with the sensing means and being arranged to stop and reverse the output of the motor in response to the sensing means when the rocker arm reaches a position sensed by the sensing means.

4. The massage device according to claim 3, wherein the sensing means includes a pair of limit switches mounted on the drive unit near the rocker arm, one of said pair of limit switches being situated on either side of the rocker arm.

5. The massage device according to claim 4, wherein at least one of the pair of limit switches is adjustable relative to the rocker arm.

6. The massage device according to claim 5, wherein the at least one of the pair of limit switches is movable by a knob attached to a helical cam.

7. The massage device according to claim 6, wherein the reciprocating means includes a reciprocating member carried by the body portion of the massage unit, the member having a first and a second pin projecting from either side of the body for reciprocating movement therewith, the massage belt having a plurality of mating portions for being attached to the pins, such that reciprocating movement of the pins of the reciprocating means concomitantly moves the massage belt therewith in a reciprocating motion.

8. The massage device of claim 1, wherein the drive movement includes a timing means for controlling said drive motor.

9. The massage device according to claim 8, wherein said timing means for controlling said drive motor is adjustable.

10. The massage device according to claim 1, wherein the massage belt includes releasable fastening means for releasably fastening the releaseable massage belt to the reciprocating means

11. The massage device according to claim 1, wherein the massage belt has a head strap.

12. The massage device according to claim 1, wherein the massage belt includes a first piece being for application to the user's body and a second piece attached to the first piece and to the massage unit.

13. The massage device according to claim 12, wherein the first and the second pieces are straps, the first piece being broader than the second piece.

14. The massage device according to claim 1, wherein the drive unit is contained in a portable container.

15. A massage device to alternatingly apply pressure and release pressure about a part of a user's body, the device comprising:

a releasable massage belt adapted to be worn about a part of a user's body;

a massage head unit connected to the massage belt;

a flexible drive cable connected to the massage head unit; and a drive unit having therein means to actuate the flexible drive cable in a reciprocating movement such that said reciprocating movement is transmitted to the massage head unit to tighten and release the massage belt thereby applying pressure and releasing pressure about the part of the user's body.

16. The massage device of claim 15, wherein the means to actuate the flexible drive cable in a reciprocating movement comprises a case having mounted thereon an electric motor having a reversible direction of movement, a crank plate driven by the electric motor, means for sequentially reversing the direction of movement of the electric motor such that the crank plate is driven in an oscillatory movement, a piston-like member connected by connector means to the crank plate such that the oscillatory movement of the crank plate is converted to reciprocatory movement of the piston-like member, the piston-like member being connected to the flexible drive cable.

17. The massage device of claim 16, wherein the means for sequentially reversing the direction of movement of the electric motor comprises a first and second limit switch spaced apart in the case and electrically connected to the electric motor, such that when the crank plate is driven in a first direction to contact the first limit switch, the direction of movement of the electric motor is reversed and the crank plate is driven in an opposite second direction to contact the second limit switch.

18. The massage device of claim 17, wherein the crank plate has an upper end, a protuberance being formed on and protruding from the upper end of the crank plate such that the protuberance may contact the first and the second limit switch when the crank plate is driven in the first direction and in the opposite second direction.

19. The massage device of claim 17, further comprising means for varying the amplitude of the oscillatory movement of the crank plate, comprising the first limit switch being adjustably disposed in the case with respect to the second limit switch such that spacing therebetween may be varied as desired, whereby the crank plate moves through a desired distance and a direction of movement is reversed.

20. The massage device of claim 16, wherein the connector means between the crank plate and the piston-like member comprises the case having a top and a bottom, a rocker arm connected to the crank plate, the rocker arm having an upper end and a lower end, the upper end of the rocker arm being pivotally connected to the top of the case, the lower end of the rocker arm being attached to the piston-like member, the piston-like member being slidably received in a guide member on the bottom of the case.

21. The massage device of claim 15, wherein the releasable massage belt comprises a broad strap which may be wrapped around the part of the user's body, the releasable massage belt further having means for attaching the releasable massage belt to the massage unit.

22. The massage device of claim 21, wherein the means for attaching the releasable of the massage belt to the massage head unit comprises the massage belt, having two ends, a tab connected to each end of the massage belt, each tab having at least one slot therein, the massage head unit having two sides, a pin projecting outwardly from each side thereof such that the respective pins may be received in the at least one slot in the respective tabs.

23. The massage device of claim 15, further comprising the massage head unit having a body portion having a first end and a second end, connecting means attached to the first end of the body portion whereby the reciprocating movement of the flexible drive cable may be transmitted to the massage head unit, and a padded plate connected to the second end of the body portion, the padded plate being in contact with the part of the user's body.

* * * * *